United States Patent [19]

Iversen et al.

[11] Patent Number: 5,018,181

[45] Date of Patent: May 21, 1991

[54] LIQUID COOLED ROTATING ANODES

[75] Inventors: Arthur H. Iversen, Saratoga; Stephen Whitaker, Davis, both of Calif.

[73] Assignee: Coriolis Corporation, Saratoga, Calif.

[21] Appl. No.: 430,902

[22] Filed: Oct. 31, 1989

Related U.S. Application Data

[63] Continuation of Ser. No. 57,339, Jun. 2, 1987, abandoned.

[51] Int. Cl.[5] ..... H01J 35/10

[52] U.S. Cl. ..... 378/144; 378/130

[58] Field of Search ..... 378/127, 130, 140, 142, 378/199, 200, 144; 313/30

[56] References Cited

U.S. PATENT DOCUMENTS

| | | | |
|---|---|---|---|
| 2,493,606 | 1/1950 | Waterton | 250/419 |
| 2,900,543 | 8/1959 | Heuse | 313/60 |
| 3,546,511 | 12/1970 | Shimula | 313/32 |
| 3,751,702 | 8/1973 | Dietz | 378/127 |
| 3,870,916 | 3/1975 | Kussel et al. | 313/32 |
| 4,238,706 | 12/1980 | Yoshihara et al. | 313/330 |
| 4,405,876 | 9/1983 | Iversen | 313/30 |
| 4,523,327 | 6/1985 | Eversole | 378/124 |
| 4,566,116 | 1/1986 | Makano et al. | 378/121 |
| 4,577,340 | 3/1986 | Carlson et al. | 378/132 |
| 4,622,687 | 11/1986 | Whitaker et al. | 378/130 |
| 4,625,324 | 11/1986 | Blaskis et al. | 378/130 |

FOREIGN PATENT DOCUMENTS 2018503 10/1979 United Kingdom .

OTHER PUBLICATIONS

"Boiling Burnout with Water in Vortex Flow"-W. R. Gambill & N. D. Greene-Chem. Eng. Progress (vol. 54#10), pp. 68-76.

"High Intensity Rotating Anode X-Ray Tubes"-A. Taylor Advances in X-Ray Analysis (vol. 9), Plenum Press, N.Y.C., Aug. 1965.

"An X-Ray Diffraction Tube with Rotating Anode for 10KW Continuous Loading"-Beekman et al., Philips Technical Review, vol. 19, 1957/58, pp. 314-317.

*Primary Examiner*—Craig E. Church

*Attorney, Agent, or Firm*—Foley & Lardner

[57] ABSTRACT

The present invention provides an internally liquid cooled rotating target of high average power capabilities that is illuminated by an energy beam wherein multiple independent centrifugal forces are established on an associated heat transfer surface to enhance heat transfer.

14 Claims, 2 Drawing Sheets

LIQUID COOLED ROTATING ANODES

This is a continuation of U.S. application Ser. No. 057,399 filed June 2, 1987, abandoned.

The present invention is directed to rotating targets illuminated by energy beams, and more particularly, to liquid cooled rotating anode x-ray tubes wherein high average power is achieved.

BACKGROUND OF THE INVENTION

The need for continuous duty, high power rotating anode x-ray tubes exists in medical radiography, i.e., fluoroscopy and computerized tomography (CT), and in industrial applications such as x-ray diffraction topography and non-destructive testing.

Liquid cooled rotating anode x-ray tubes are, in general, well known. In such x-ray tubes, a hollow anode is disposed so that a rotating portion thereof is irradiated by an energy beam (e.g., electron beam). The irradiated portion of the anode is generally referred to as the electron beam track. Substantially all of the heat generated by irradiation by the energy beam is transmitted to a heat exchange surface, typically the interior wall of the hollow anode underlying the electron beam track and adjacent areas. In other words, the heat exchange surface is generally an area of the interior surface of the anode larger than the electron beam track. A flow of liquid coolant is passed into contact with the heat exchange surface to remove the heat therefrom, and thus cool the anode.

It is also well known that a centrifugal force in the presence of a liquid cooled heat transfer surface that is cooled by nucleate boiling can increase the effective rate of heat transfer by the more efficient removal of nucleate bubbles. In prior art devices, however, only a single source of centrifugal force is utilized. More specifically, devices utilizing a curved heat transfer surface disposed on the interior of a hollow target, which rotates about a stationary, coaxially disposed septum to generate a centrifugal force, are known. In general, in such devices the coolant velocity vector and the curved heat transfer surface lie in the planes containing the line of the axis of anode rotation. The general flow of coolant is axial, that is, along the line of the axis of anode rotation, approximately radially up an input anode face, axially across the anode heat exchange surface, and then approximately radially down a discharge face of the anode, to be discharged axially along the line of the axis of anode rotation. The useful curvature of the heat exchange surface is concave and interacts with the flow of coolant such that a single centrifugal force proportional to the square of the relative tangential velocity between the coolant and curved surface is established on the curved anode surface.

It would be desirable to independently generate additional centrifugal forces to further enhance heat removal at the heat transfer surface. Independent control of each source of centrifugal force would facilitate optimization of system performance parameters while enhancing heat transfer.

SUMMARY OF THE INVENTION

The present invention provides an internally liquid cooled rotating target of high average power capabilities that is illuminated by an energy beam (such as, for example, electromagnetic, e.g., a laser; positively or negatively charged particles, e.g., electrons or ions, or neutral particles) wherein multiple independent centrifugal forces are established on an associated heat transfer surface to enhance heat transfer.

It is an object of the present invention to generate multiple independent centrifugal force pressure gradients on the heat transfer surface and thereby increase the heat flux removal from the curved heat exchange surface.

It is a further object of the present invention to simplify the construction of a rotating target assembly.

It is yet another object of the present invention to enable greater precision in the construction of the curved heat transfer surfaces.

It is still yet another object of the present invention to provide a rotating anode of simple construction with longer-lived characteristics.

The foregoing is accomplished by constructing the rotating target with a curved heat transfer surface as a unitary structure with all internal anode components rigidly affixed to one another and by providing means within the rotating anode (or target) assembly to cause the liquid coolant to rotate at approximately the same absolute angular velocity and in the same direction as the target. In this manner, two separate and distinct centrifugal forces are established, one arising from the relative tangential velocity of the coolant flow over the curved heat exchange surface and the other due to the absolute angular velocity of the liquid coolant within the anode.

BRIEF DESCRIPTION OF THE DRAWINGS

A preferred exemplary embodiment of the present invention will hereinafter be described with reference to the appended drawings, wherein like numerals denote analogous elements, and.

DETAILED DESCRIPTION 0F A PREFERRED EXEMPLARY EMBODIMENT

Figure 1:
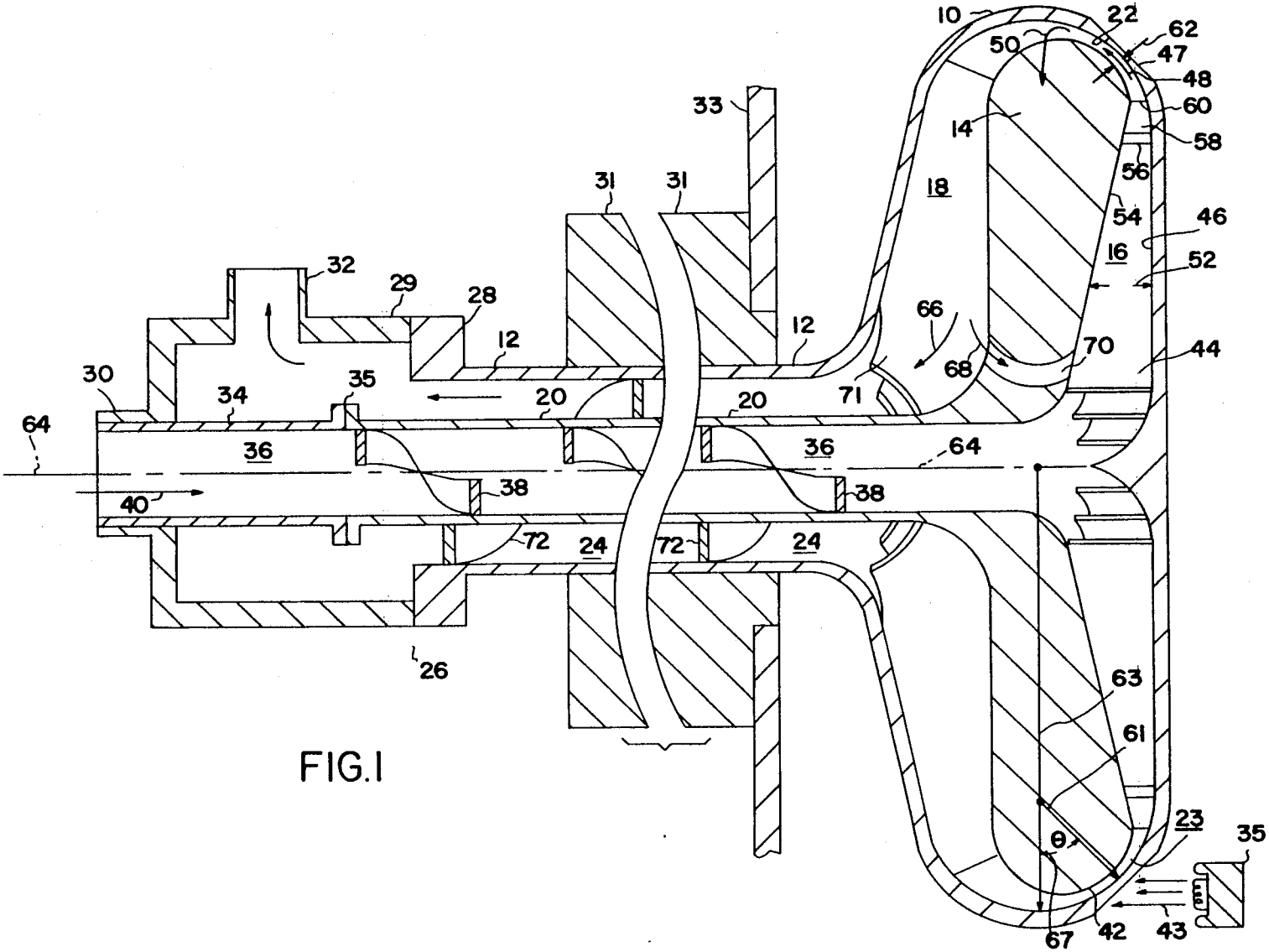
FIG. 1 is a cross-sectional view of an internally liquid cooled rotating anode (or target) illustrating a unitary construction of the anode and septum, in accordance with the present invention.

Referring now to FIG. 1, a hollow anode 10 is centered with and fixedly mounted on outer hollow rotating shaft 12 and rotatably driven with shaft 12 about its axis, generally indicated as line 64. A septum 14 is spaced from, and fixedly attached to, hollow anode 10, forming, in cooperation with anode 10, anode coolant input and discharge conduits 16 and 18, respectively. A center tube 20 is fixably attached to septum 14, generally coaxial with shaft 12 and adapted for rotation with anode 10, shaft 12, and septum 14. Center tube 20 provides an interior conduit 36 extending through septum 14 to communicate with input conduit 16. A conduit 24 communicating with output conduit 18 is defined by the inside diameter of outer hollow rotating shaft 12 and the outside diameter of inner rotating tube 20.

A curved heat exchange surface 22 is provided on the interior wall of anode 10. For ease of illustration, the details of the geometry of curved surface 22 are not shown. For a description of such geometry, reference is made to U.S. Pat. No. 4,622,687, issued Nov. 11, 1986 to the present inventors, and commonly owned herewith. Septum 14 includes a convex curved surface 42 in the proximity of concave curved anode heat transfer surface 22, defining therebetween a conduit 23 (also sometimes hereinafter referred to as "heat exchange region 23"), communicating between input conduit 16 and output conduit 18.

Outer hollow rotating shaft 12 extends to, and mates with, a rotating union 26. Rotating union 26, comprising a rotating segment 28 and a stationary segment 29, provides an essentially liquid-tight union. Rotating segment 28 serves as a rotating sealing face, and preferably comprises a flange at the end of shaft 12. The face end of shaft 12 may also be utilized as the rotating sealing face. This has the benefit of economy and compactness. Stationary segment 29 of union 26 includes respective input and output hose couplers 30 and 32.

An internal rotating union 35 is provided to mate rotating inner tube 20 with a coaxially disposed stationary inner tube 34. Stationary tube 34 is hermetically sealed to stationary member 29 of union 26 at input coupler 30, and effectively extends interior conduit 36 to input coupler 30. Rotating tube 20 suitably protrudes a distance into stationary segment 29 to facilitate inspection and maintenance of rotating union 35. Rotating union 35 need not be liquid-tight; leakage of input coolant through rotating union 35 into the discharge coolant in conduit 24 need only be within acceptable limits.

In operation, coolant liquid is introduced to the system through input coupler 30, into conduit 36 within stationary interior tube 34 and inner rotating tube 20 (input flow generally indicated by arrow 40). The coolant enters, then flows up anode input conduit 16, through the heat exchange region 23, then down anode discharge conduit 18 and out conduit 24, ultimately exiting through output hose coupler 32.

Energy beam 43, e.g., electrons, from a source, e.g., electron gun 35, impinges on a focal track 47. The heat generated is conducted to internal heat transfer surface 22. At heat transfer surface 22, heat is removed by boiling coolant which is generally in turbulent flow.

Tube 20 may contain a variable spiral element 38 or other means which serve to gradually and smoothly cause the linear coolant flow 40 from stationary tube 34 to rotate without creating undesirable flow characteristics such as cavitation. When the coolant reaches the entrance of anode coolant input conduit 16, it is engaged by respective centrifugal flow pump vanes 44 mounted on the input face 46 of anode 10. Centrifugal flow pump vanes 44 serve to accelerate the liquid coolant both radially (as indicated by arrow 48) and circumferentially (as indicated by arrow 50). The positioning and length of vanes 44 in conduit 16 may be varied for optimum performance, e.g., to control the coolant flow characteristics and/or the absolute angular velocity of the coolant. Other means such as, for example, gear pump elements may also be used. Centrifugal flow pump vanes 44 terminate at a location 56 prior to the curved anode heat transfer surface 22. Extending the vanes 44 into the anode heat transfer region 23 could significantly reduce heat transfer because of premature burnout caused by the low pressure region that is present on the downstream side of the vanes.

Secondary flow directing vanes 58 may be employed to smooth out and make uniform the coolant flow as it departs the centrifugal flow pump to the heat exchange region 23. Vanes 58 also terminate at a location 60 prior to heat exchange region 23.

In general, it is desirable to make the height (indicated by arrows 52) of input conduit 16 as it proceeds from the juncture with conduit 36 as large as possible, i.e., large cross-section, thereby reducing the coolant shear velocity along anode face 46 and septum face 54 to a minimum. The foregoing also applies to discharge conduit 18. This has the benefit of minimizing pressure drops associated with high shear velocities. Conversely, because high radial coolant velocities 48, i.e., turbulent flow, needed over heat transfer surface 22 for high heat flux removal, result in relatively low bulk temperature rises in the coolant, it is usually desirable to maintain the height (indicated by arrows 62) of anode heat exchange region conduit 23 as small as practical, e.g., 0.02 mm to 5 mm, thereby minimizing the coolant volume flow requirements. A further means for reducing coolant volume flow requirements, especially in microfocus x-ray tubes where heat flux levels are high, but average power levels are low, is to provide for partial recirculation of the coolant within the anode. Discharge coolant in conduit 18 may be divided into two flows (indicated by arrows 66 and 68), wherein coolant flow 66 discharges out conduit 24 and coolant flow 68 passes through a conduit 70 in septum 14 to join incoming coolant 48. Multiple conduits 70, joining discharge conduit 18 with input conduit 16, are spaced periodically around the axis 64 of rotating septum 14.

Maximum coolant velocity 48 is desired in heat transfer region 23 to maximize one of the desired centrifugal forces. The first centrifugal force, $a_1$, is proportional to $$\frac{v_1^2}{gr}$$

where $v_1$ is the coolant tangential velocity 48 relative to curved anode surface 22 that lies in the plane shown in FIG. 1, i.e., the planes containing and rotated about the line of the axis 64 of anode rotation; also sometimes hereinafter referred to as the plane containing the axis of (anode or target) rotation; r is the local radius 61 of curvature of curved anode surface 22; and g is the gravitational constant. This centrifugal force gives rise to a pressure gradient having a component perpendicular to the heat exchange surface which causes the more rapid removal of nucleate bubbles by radial vapor transport, thereby improving heat transfer.

A second centrifugal force arises from the absolute angular velocity 50 of the liquid coolant. Here the angular velocity 50 lies in the plane of anode rotation, i.e., a plane that is orthogonal to the line of the axis 64 of anode rotation. Thus, absolute angular velocity vector ($v_2$) 50 is always orthogonal to relative tangential velocity vector ($v_1$) 48. The second-centrifugal, force, $a_2$, is proportional to $$\frac{v_2^2}{gR},$$

where $v_2$ is the absolute angular velocity 50 and R is the radius 63 of the anode.

This centrifugal force gives rise to a pressure gradient having a component perpendicular to the heat exchange surface which also causes more rapid removal of nucleate bubbles by radial vapor transport, thereby improving heat transfer. The centrifugal force arising from the absolute angular velocity 50 is directed along the anode radius 63. Therefore, at the curved anode heat transfer surface 22 position shown by arrow 61, which indicates the anode focal track centerline, the centrifugal force perpendicular to the heat exchange surface due to coolant rotation 50 at 61 is proportional to cos $\theta$ (angle $\theta$ generally indicated as 67). The angle $\theta$ may vary with application, e.g., 13° for medical, 20° for industrial, and 0° for crystallography. At $\theta=90°$, the force component will go to zero. First centrifugal force $a_1$, from coolant flow 48 over curved anode surface 22, is inversely proportional to the local radius of curvature and is independent of angle $\theta$. Thus, the respective centrifugal force can be adjusted by varying the curvature of heat exchange surface 22; its angular disposition relative to the anode radius, the radial coolant velocity or any combination thereof.

After passing through anode heat exchange region 23, the coolant flow passes into discharge conduit 18. Means may be placed in discharge conduit 18 to progressively reduce the rotational component of velocity 50 imparted by the centrifugal flow pump vanes 44 to the coolant, in a manner such that much of the mechanical energy imparted to the coolant by the vanes is returned to the anode. This reduces the anode drive requirements, and results in a more efficient system. For example, turbine vanes 71 may be incorporated in discharge conduit 18. The positioning and length of vanes 71 may also be optimized.

The discharge coolant flow then passes into discharge conduit 24. Discharge conduit 24 may also be provided with a variable spiral element 72 or other means, which gradually reduce the remaining rotational velocity of the discharge coolant until, as it approaches discharge port 32, it becomes essentially a linear flow. If discharge port 32 is made tangent rather than centered to stationary segment 28 of rotating union 26, some rotation of the coolant may be desirable; the rotating coolant then can be caused to efficiently couple directly into the discharge port 32, thereby aiding in propelling the coolant through port 32.

After leaving discharge port 32, the coolant passes through a heat exchanger (not shown) and, if needed, a pump (not shown), and thence back to tube input port 30.

For vacuum tube use, e.g., x-ray tubes, free electron lasers, linacs, etc., a ferrofluid bearing assembly 31 is employed to provide a high vacuum rotating seal and a suitable vacuum envelope 33 to contain the rotating anode 10 and electron gun 35, etc. In laser target and similar applications, the rotating target may operate in atmosphere or a controlled atmosphere instead of a vacuum.

The unitary construction of the present invention wherein all elements within the anode are fixedly attached to the anode and rotate with it provides a number of advantages. With the septum fixed to and rotating with the anode, it is not necessary to employ support bearings mounted within the anode to permit the septum to be stationary while the anode rotates and maintain precision alignment between the stationary septum and rotating anode. Elimination of the stationary septum-rotating anode bearing reduces the probability of tube loss due to bearing failure, and therefore, can contribute to extending tube life. Elimination of the stationary septum-rotating anode bearing and associated assembly can also reduce tube construction costs. Further, with all internal anode members fixed by mounting to the anode, more precise, and therefore, closer spacing of the anode to septum in the heat transfer region may be achieved. This can reduce coolant volume flow requirements while maintaining needed coolant velocities over anode heat transfer surface 22.

Figure 2:
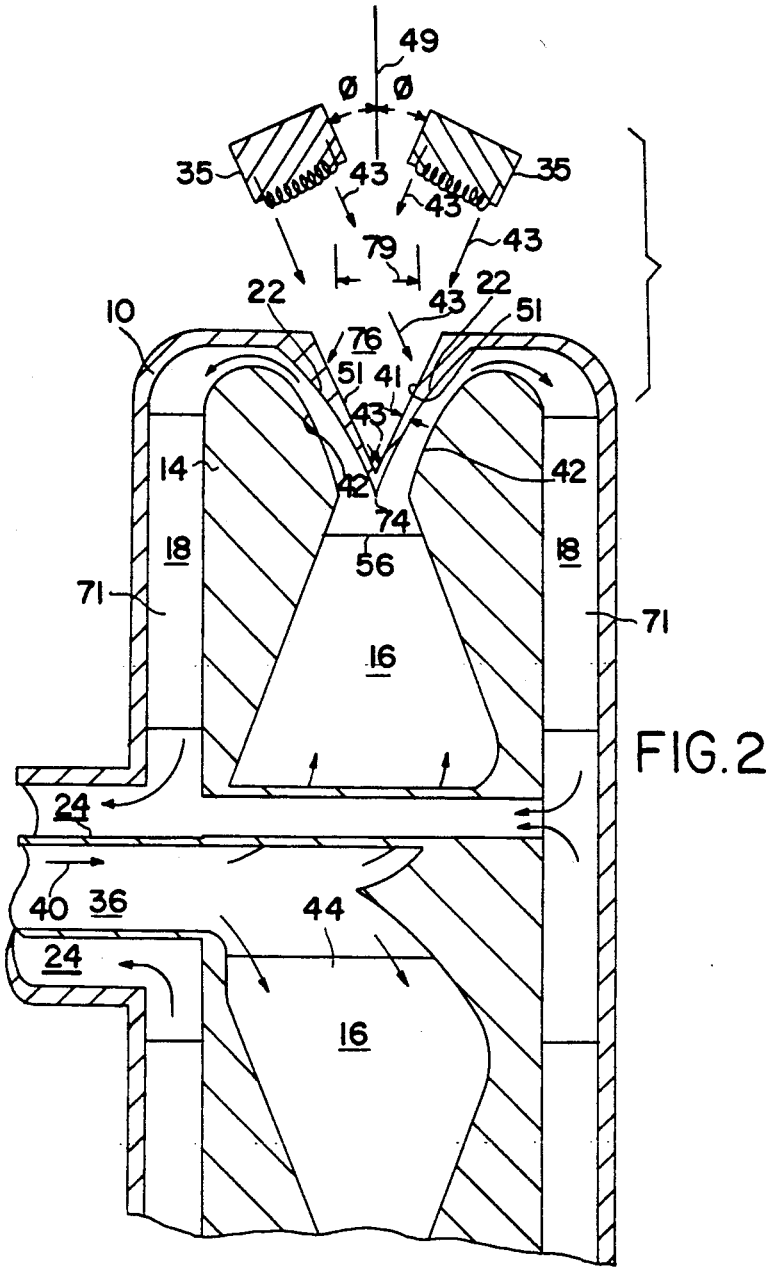
FIG. 2 is a cross-sectional view of a "V" groove rotating anode of unitary construction in accordance with the present invention.

Referring now to FIG. 2, an anode incorporating a "V" groove 76 will be described: "V" groove 76 is suitably formed with respective opposing face 51 extending from interior apex 74 at a predetermined angle from a center line 49, preferably parallel to the anode radius.

A "V" groove geometry enables a long line focal spot to be projected as a relatively small focal spot 79 while obtaining a relatively uniform radiation intensity distribution over most of the included angle of the "V" groove. This type of anode has application in x-ray lithography manufacturing of semiconductor devices. X-ray lithography is generally conducted in the 10–30 KV range, requiring high electron beam currents to reach desired high average powers. To achieve high electron beam currents, a modified version (e.g., linear) of the circular Gaines-type electron gun may be used, or dual electron guns 35 may be used. Each gun 35 is positioned at an angle $\phi$ and on each side of the centerline 49 of "V" groove 76, and illuminates each of the opposing faces 51. If desired, the electron guns 35 may also be displaced circumferentially and angled in such a manner that the electron beams illuminating each side 51 of the "V" groove 76 remain aligned with each other and are not displaced circumferentially with respect to each other. Both beams thus project as an unbroken x-ray focal spot that is essentially continuous from one side of the "V" groove surface 51 to the other, e.g., an unbroken square or rectangle. This circumferential displacement of the electron guns allows emerging x-rays of focal spot 79 to avoid interception by electron guns 35.

Incoming coolant 40 in conduit 36 is engaged by respective centrifugal flow pump vanes 44 as it enters an input conduit 16. After being accelerated radially and circumferentially, the coolant departs centrifugal flow pump vane 44 at point 56, flows toward apex 74 of the "V" groove 76 where the coolant flow bifurcates, approximately half the coolant flow passing up each side of concave curved anode heat exchange surfaces 22 disposed on the interior of faces 51. Concave curved anode heat exchange surfaces 22 and respective corresponding convex curved surface 42 of septum 14 form conduit 23. After passing over heat exchange surfaces 22, the coolant flows into discharge conduits 18. Means such as turbine vanes 71 are provided in discharge conduits 18 to reduce the absolute angular velocity of the discharge coolant. The coolant is then discharged out conduit 24. As in the embodiment of FIG. 1, input conduit 36 and output conduit 24 may be provided with means such as variable spiral elements 38 or 72 to increase and decrease the rotational velocity of input and discharge coolant flows while traveling axially inward, conduit 36 or outward, conduit 24.

As in the embodiment of FIG. 1, all internal anode elements, e.g., septum 14, vanes 44 and 71 are fixedly attached to and rotate with anode 10. Likewise, all the design considerations discussed in conjunction with FIG. 1 regarding analogous elements and the disposition thereof, e.g., conduit geometries, also apply to the embodiment of FIG. 2.

The opposing faces 51 of "V" groove 76 are shown in FIG. 2 as linear. Concave curved anode heat exchange surfaces 22, however, may, in general, be characterized as diverging curves commencing at apex 74. Thus, the "V" groove wall thickness 41 increases as the distance from the apex 74 increases. For a given electron beam power density and constant temperature on boiling cooled surface 22, as the "V" groove wall thickness 41 increases, the surface temperature on the electron beam side 51 of the "V" groove increases. Therefore, it could be desirable to also curve the electron beam side 51 of the "V" groove to maintain a constant wall thickness. Side 51 would then have a convex curvature whose slope corresponded substantially to the concave curved liquid cooled surface 22. However, as side 51 curved, the electron beam density would vary and could result in overheating. A preferred "V" groove 76 wall thickness 41, i.e., curvature, may be achieved, thereby minimizing surface 51 temperature, by selecting a curvature for surface 51 that provides a variable wall thickness 41 that lies between that of the linear V shape shown in FIG. 2 and the constant wall thickness resulting from "V" groove surface 51 having a convex curvature corresponding to the concave curvature of heat transfer surface 22. The desired curvature of surface 51 may be approximated by a series of connected straight lines each at successively increasing angles with respect to centerline 49 when starting from apex 74.

Figure 3:
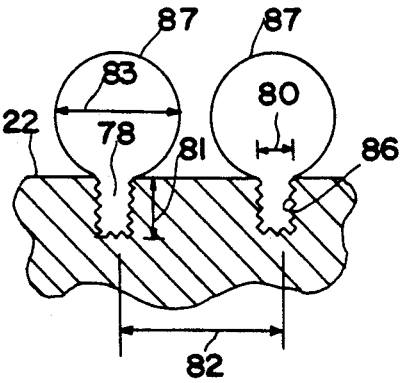
FIG. 3 is a cross-sectional view of nucleating site cavities on the curved anode heat exchange surface.

Referring now to FIG. 3, to enhance boiling heat transfer, the curved anode heat transfer surface 22 may be prepared with nucleating site cavities 78 of optimum dimensions 80, 81 and spacing 82 such that maximum heat flux removal is achieved without encountering the potentially destructive condition of film boiling, e.g., burnout. That is, under conditions of maximum heat flux, the cavity-to-cavity spacing 82 is such that nucleate bubbles 87 of diameter 83 do not coalesce to form film boiling. Cavity dimensions, such as diameter 80 and depth 81, may range from 0.002 mm to 0.2 mm and spacing 82 between cavities on the heat exchange surface may range from 0.03 mm to 3 mm. This specified geometry of nucleating cavity dimensions 80 and spacing 82 between cavities may be achieved chemically, e.g., chemical milling, electronically, e.g., lasers or electron beams, or mechanically, e.g., drilling, hobbing, etc.

Figure 4:
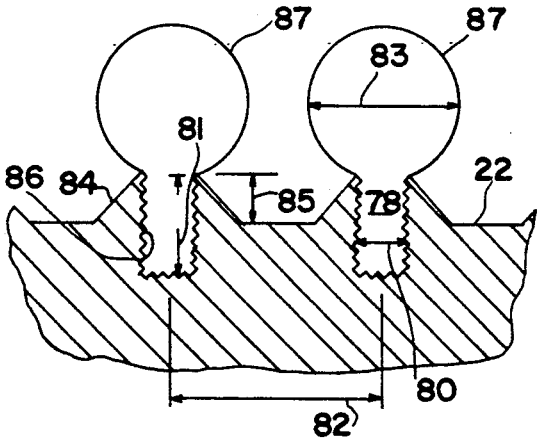
FIG. 4 is a cross-sectional view of roughness elements on the curved anode heat exchange surface.

Heat transfer may be further enhanced by breaking up the viscous sublayer formed in the coolant proximate to the heat exchange surface. Referring to FIG. 4, roughness elements, e.g., truncated cones 84, that range in height from about 0.3 times the thickness of the viscous sublayer to about several times the height of the combined thickness of the viscous sublayer and adjacent transition zone are provided on the heat transfer surface. In general, the height of the truncated cone ranges from 0.0001" to about 0.008". If desired, cavities 78 may be disposed on the truncated cones 84.

To further enhance nucleate boiling, the inside surfaces of the cavities serving as nucleate boiling sites and the outer surface of the truncated cones may be further prepared with microcavities 86, preferably re-entrant, with dimensions generally in the range of $10^{-4}$ mm to $10^{31\ 2}$ mm. Microcavities 86 serve as long-lived vapor traps that remain in equilibrium with the liquid and serve as the initial nucleate boiling site until the larger cavities 78 commence nucleate boiling. Thus, full scale nucleate boiling becomes a two-step affair, with initial nucleate boiling taking place at the trapped vapor sites, and then in the larger cavities 78 when sufficient vapor has been accumulated. Microcavities 86 may be created by judicious selection of diamond (or other cutting material) particle size which is embedded in the drill bit. With the laser, reactive liquids, vapors, or gases may be introduced or the surface may be coated with a material that decomposes upon heating, which react with the anode or target material to create the desired pitting (microcavities) effect.

It should be noted that cavity 78 and roughness 84 geometry, in general, will not necessarily have the clearly defined geometries shown in FIGS. 3 and 4, e.g., diameter 80, height 85 and depth 81, but, depending on the nature of manufacture, may be oblong, re-entrant, random, etc. Diameter 80 and depth 81 here refer to effective dimensions wherein approximately equivalent nucleate bubble or vapor generation characteristics are obtained from a cavity of specified random dimensions.

It will be understood that the above description is of preferred exemplary embodiments of the present invention and that the invention is not limited to the specific forms shown. Modifications may be made in design and arrangements of the elements without departing from the spirit of the invention as expressed in the appended claims.

What is claimed is:

1. Apparatus comprising:

a hollow target, rotatable about an axis of rotation, said target being subject to heating and including a heat exchange surface on the interior thereof, said heat exchange surface comprising nonlinear curves in planes parallel to the axis of rotation of said target; and a septum, fixed within said hollow target for rotation with said target, and cooperating with the interior of said target to define a conduit;

said conduit being configured to direct a flow of coolant liquid past said heat exchange surface to remove heat from said heat exchange surface by formation of nucleate vapor bubbles on said heat exchange surface;

said heat exchange surface curves interacting with said coolant to generate a first centrifugal force creating a pressure gradient in said coolant, said first centrifugal force having a magnitude proportional to the square of the relative velocity between said coolant and said heat exchange surface, and having a component perpendicular to said heat exchange surface;

said apparatus further including means, cooperating with said conduit, for causing said coolant to rotate with said target at approximately the same absolute angular velocity to generate a second centrifugal force creating a pressure gradient, said second centrifugal force having a magnitude proporational to the square of the absolute angular velocity of said rotating liquid coolant, and having a compenent perpendicular to said heat exchange surfaces.

2. The apparatus of claim 1, wherein said target is an anode disposed for irradiation by an energy beam.

3. The apparatus of claim 1, further including an envelope and an energy beam source mounted within said envelope for generating an energy beam; and wherein:

said target comprises a hollow anode, having an outer surface, disposed within said envelope, such that said energy beam irradiates a portion of said outer surface of said anode predetermined disposition to said heat exchange surface.

4. The apparatus of claim 1, further including a rotating union cooperating with said target and said septum.

5. The apparatus of claim 3, wherein the exterior circumferential surface of said anode includes a generally V-shaped groove disposed for irradiation by said energy beam, and said heat exchange surface comprises, for each side of said V-shaped groove, respective concave curves lying in the planes containing the axis of rotation of said anode and, said septum includes respective surfaces generally corresponding to said respective heat exchange surface curves.

6. The apparatus of claim 5, wherein the sides of said V-shaped groove are formed of connected line segments, each segment being at a different angle, to generally conform to the curvature of said heat exchange surface concave curves.

7. The apparatus of claim 1, wherein said means for causing said coolant to rotate with said target comprises centrifugal flow pump vanes.

8. The apparatus of claim 7, wherein said target includes an exhaust face disposed downstream in said coolant flow from said heat exchange surface, and said apparatus further comprises exhaust turbine vane means, affixed to said exhaust face, for reducing rotationally induced velocity in said coolant after it has passed the heat exchange surface.

9. The apparatus of claim 8, further comprising means, disposed within said hollow target, for redirecting a predetermined portion of coolant which has passed over the heat exchange surface to join incoming coolant and effect a partial recirculation of coolant within said target.

10. The apparatus of claim 1, wherein said septum includes at least one recirculation conduit disposed to recirculate a predetermined portion of coolant which has passed the heat exchange surface.

11. The apparatus of claim 1, wherein said heat exchange surface includes cavities, said cavities having dimensions ranging from 0.002 mm to 0.2 mm and spaced apart on said heat exchange surface at distances from 0.03 mm to 3 mm.

12. The apparatus of claim 11, wherein the surfaces of said cavities include microcavities ranging from about $1\times10^{-4}$ mm to $1\times10^{-4}$ mm in diameter.

13. The apparatus of claim 1, wherein said heat exchange surface includes roughness elements, said roughness elements being approximately in the shape of truncated cones having bases affixed to the heat exchange surface, said cones being of a height ranging from 0.0001 inch to 0.008 inch.

14. A liquid cooled rotating anode having a characteristic radius, the anode being adapted for irradiation by an energy beam comprising:

an arcuate heat exchange surface on the interior of said anode, said arcuate surface having curves in planes parallel to the axis of rotation of said anode; and a septum, fixed within said anode for rotation with said anode, cooperating with said anode to define a conduit being configured to direct a flow of coolant liquid past said heat exchange surface to remove heat from said heat exchange surface by formation of nucleate vapor bubbles on said heat exchange surface;

said heat exchange surface interacting with said coolant to generate first and second centrifugal forces creating respective pressure gradients in said coolant, said first centrifugal force being inversely proportional to the local radius of curvature of said curves, said second centrifugal force being proportional to said characteristic radius.

* * * * *